United States Patent [19]

Tice et al.

[11] 4,339,043

[45] Jul. 13, 1982

[54] PORTABLE MINING APPARATUS

[76] Inventors: Richard P. Tice; Isabelle L. Tice, both of N. 3211 Nelson, Spokane, Wash. 99206

[21] Appl. No.: 230,860

[22] Filed: Feb. 2, 1981

[51] Int. Cl.[3] ..... B03B 7/00

[52] U.S. Cl. ..... 209/44; 209/251; 209/451; 209/501

[58] Field of Search ..... 209/44, 270, 284, 288, 209/296, 297, 420, 421, 18, 298, 299, 251, 260, 447, 451, 506, 458, 473, 500, 501, 452

[56] References Cited

U.S. PATENT DOCUMENTS

| | | | |
|---|---|---|---|
| 6,771 | 10/1849 | Lacharme | 209/270 X |
| 211,824 | 1/1879 | Wilhelm | 209/44 |
| 450,756 | 4/1891 | Hull | 209/44 |
| 595,457 | 12/1897 | Lay | 209/501 X |
| 601,582 | 3/1898 | Milton | 198/311 X |
| 612,706 | 10/1898 | Crow | 209/44 X |
| 741,136 | 10/1903 | Hurst | 209/298 X |
| 832,972 | 10/1906 | Hardwick | 209/44 |
| 893,368 | 7/1908 | Quigley | 209/44 |
| 928,965 | 7/1909 | Hanna | 209/284 X |
| 1,069,244 | 8/1913 | Ford | 209/284 |
| 1,335,675 | 3/1920 | Featherstone | 209/420 X |
| 1,428,125 | 9/1922 | Street | 209/270 X |
| 2,064,554 | 12/1936 | Mahoney | 209/44 X |
| 3,154,189 | 10/1964 | O'Hanlon | 198/311 X |
| 3,439,806 | 4/1969 | Kass | 209/420 X |
| 3,750,884 | 8/1973 | Sutake | 209/284 |
| 3,970,551 | 7/1976 | Wright | 209/458 |

FOREIGN PATENT DOCUMENTS

| | | | |
|---|---|---|---|
| 27691 | 3/1917 | Norway | 209/270 |
| 21135 | of 1914 | United Kingdom | 209/270 |
| 438636 | 11/1935 | United Kingdom | 209/297 |

OTHER PUBLICATIONS

Gold in Placer, Douglas, published by Harnacy, 1944.

*Primary Examiner*—Robert Halper
*Attorney, Agent, or Firm*—Wells, St. John & Roberts

[57] ABSTRACT

A self-contained revolving trommel classifying and sluice type recovery plant is described. The trommel screen is perforated and provided with helical corrugations to subject received placer material to several forces which, combined with sufficient water added through provided nozzles, break up the placer material and expose values to the trommel perforations. The perforations are arranged in a continuous pattern within the length of the trommel. Classified material drops through the perforations into an elongated sluice, along with all the accumulated water used in the classifying-washing process. Values are separated from tailings by corrugations along the sluice length. A suction pump operates with a suction hose and settling tank to recover values from the sluice during operation.

28 Claims, 8 Drawing Figures

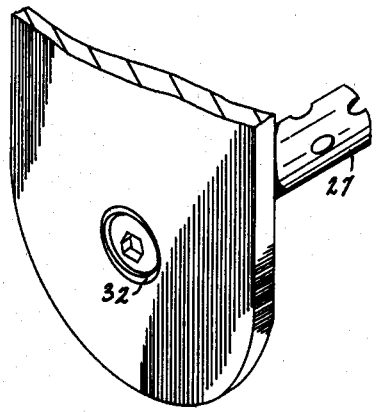
FIG 6
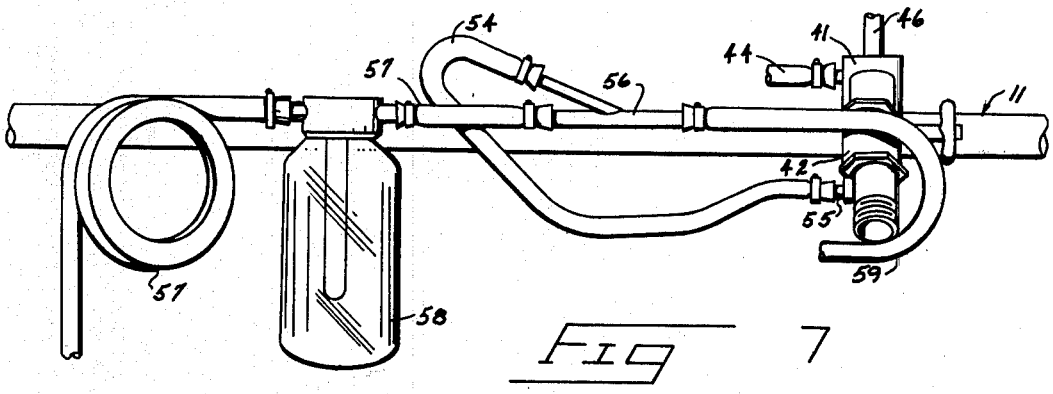
FIG 7
FIG 8
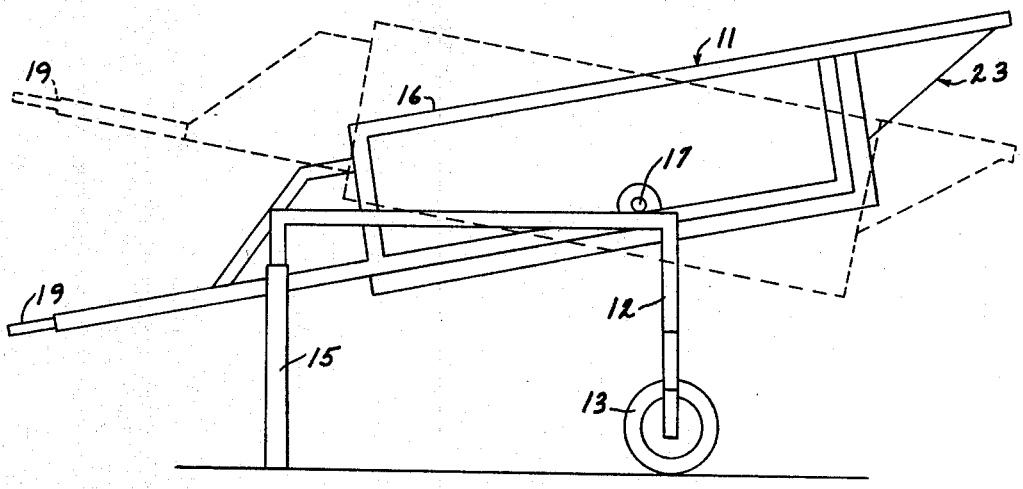

PORTABLE MINING APPARATUS

TECHNICAL FIELD

The present invention is related to portable mining apparatus and more particularly to such portable apparatus having capability of both classifying and concentrating values from placer material.

BACKGROUND OF THE INVENTION

Traditionally gold prospectors have used dredges, sluice boxes, gold pans, etc. for on-site classification and concentration. However, all the above mentioned tools are designed for the principle of in-stream operation, thus leaving many old stream beds or glacial deposits virtually untouched.

Most one-man placer operations have been limited to areas directly adjacent to or within a stream bed itself. In many instances, the values are not limited to this confined area. Therefore, the miner is restricted by his equipment rather than knowledge or intuition as to where deposits may be located.

In the past, most mining for precious metals such as gold has meant high volume production. Now, however, with many regulations in effect and many more in planning stages, there is a need for a small efficient machine that does not require heavy equipment for prospecting or simply working a placer claim on a small scale. Such an apparatus would also be desirable for cleaning up behind a heavy duty dredge or sluice box. It is also desirable to provide an apparatus that will complete total separation of precious metals from placer material. Such an apparatus would eliminate costly separation methods that can also be dangerous (as when retorts are used).

The present apparatus allows for freedom to placer mine some distance from a stream or other water source. The self-contained nature of the present apparatus facilitates total portability for reaching previously inaccessible areas. In addition, because the apparatus may be situated some distance from a water source, the tailings and water discharge do not quickly reenter the stream. The result is the effect on stream bed ecology is minimal, and many government regulations are automatically compiled with.

The present apparatus is also very effective in concentrating values from placer material. Gold, for example, can be recovered without need for expensive additional equipment or dangerous chemicals.

BRIEF DESCRIPTION OF THE DRAWINGS

FIG. 6 is an enlarged fragmentary detail of an end plug assembly for the present trommel axle;

FIG. 7 is an enlarged detail view of a suction means; and

FIG. 8 is a diagrammatic view illustrating different operational positions of pivoted frame sections of the invention.

DETAILED DESCRIPTION OF A PREFERRED EMBODIMENT

Figure 1:
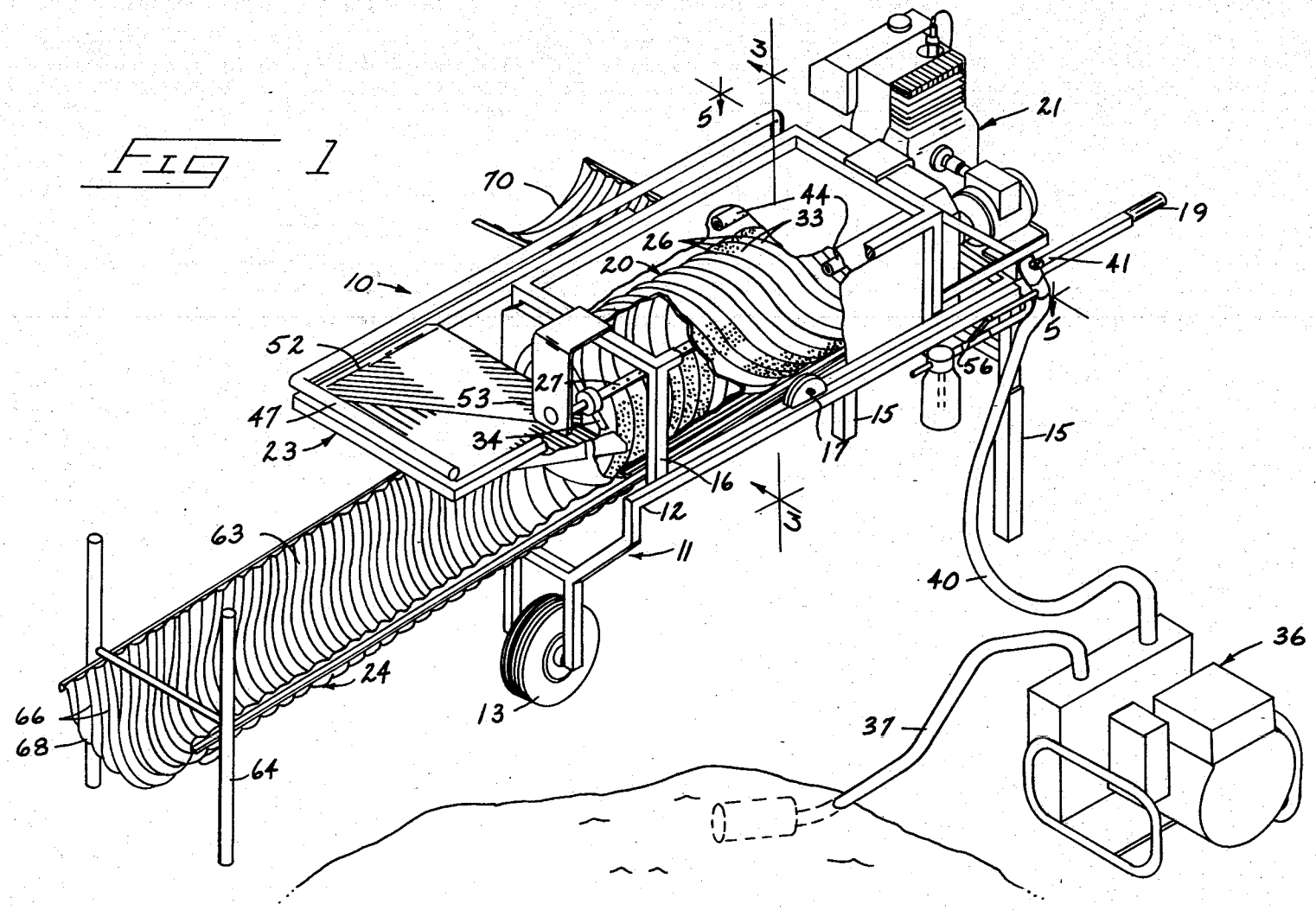
FIG. 1 is a fragmented pictorial view illustrating the present apparatus in an operative mode.

The present apparatus, generally shown in the drawings at 10, is provided as a combination of a novel trommel type classifier and a sluice concentrator on a portable frame that will allow hand transport of the apparatus and operation at remote placer sites. The apparatus 10 is intended for use by both professional and amateur prospectors as an effective separator of precious metals such as gold from various grades of placer material.

The apparatus 10 is provided with a general portable framework 11. The framework may include a rigid frame (not shown) or two interfitted subframes (shown in FIGS. 1, 2 and 8). Both forms of the frame are supported along the ground surface by one or more wheels 13. The axes of the wheel or wheels 13 is substantially transversed to the longitudinal dimension of the frame and centered along the length thereof. The frame preferably includes stabilizing legs 15 at one end thereof. The legs 15 preferably telescope adjustably to allow angular positioning of the frame in relation to a horizontal plane. Hand grips or handles 19 extend longitudinally from the frame to permit manual movement of the apparatus and selective adjustment of the angular orientation for the apparatus relative to a ground or support surface. Selective adjustment of the apparatus angularly relative to the ground surface can be accomplished with the unitized frame structure by adjustably lengthening or shortening the legs 15. If a frame embodying two pivoted subframes is used, such adjustment may be made as shown in FIG. 8 by pivoting one of the subframes relative to the other.

In the form of framework 11 utilizing two pivoted subframes, a first subframe 12 is supported along the ground surface by the wheels 13. The stabilizing legs 15 are also mounted to this subframe. The legs 15, in this situation, do not necessarily telescope due to the angular adjustability of the two interconnected subframes.

The second subframe 16 is mounted to the wheel supported frame 12 for pivotal movement about a transverse axis. The pivot axis is defined by a pair of pivot pins 17 interconnecting subframes 12 and 16. The axis defined by pins 17 is transverse to the lengths of the frames and substantially parallel to the wheel axis. Selective adjusting fasteners such as lock nuts, detent assemblies, etc. may be used in conjunction with the pivot pins to provide incremental selective pivotal movement of the frame 16 relative to the wheel supported frame 12. FIG. 8 shows extreme pivoted positions of the subframes. The hand grips 19 extend longitudinally from the second subframe 16 to permit manual movement of the apparatus and angular adjustment.

A rotatable trommel 20 is mounted to the frame 11. In the subframe arrangement shown, the trommel is rotatably mounted to the second subframe 16. The trommel 20 is rotated about a central longitudinal axis by a drive means 21 such as a standard gasoline engine and gear reduction mechanism.

Placer material (not shown) is fed into the trommel 20 through a hopper 23. The placer material is classified within the trommel and the small graded placer particles fall into a sluice 24. The graded placer material (small particles) fall into the sluice 24 through a perforated cylindrical wall 25 of the trommel.

Figure 3:
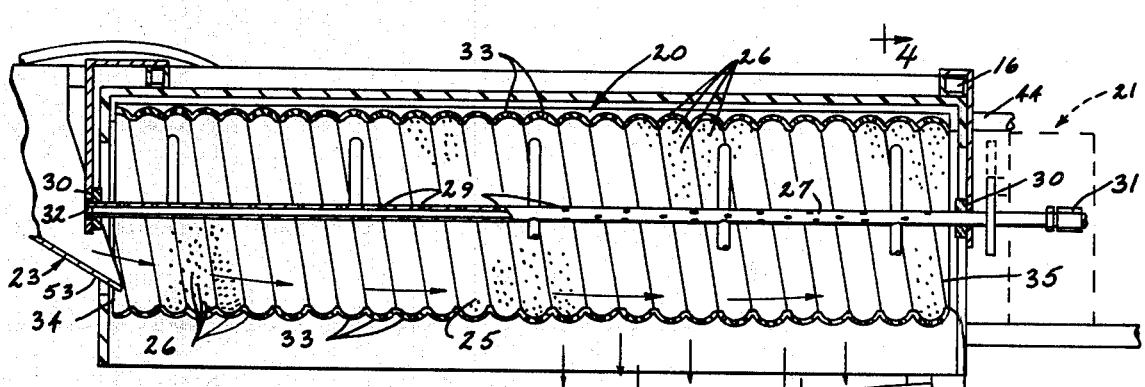
FIG. 3 is an enlarged fragmentary sectional view taken substantially along line 3—3 in FIG. 1.

The trommel 20 is shown in particular detail in FIGS. 1 and 3. The trommel is supported by a central axle 27 that is hollow along its length. The axle 27 is supplied with radial struts 28 extending outwardly to a cylindrical perforated trommel wall 25. The struts 28 center the axle 27 coaxially within the core of the trommel. The axle 27 is therefore coaxial with the central rotational axis for the trommel.

The central axle 27 is provided with a series of apertures 29 along its length for receiving and delivering a fluid such as water to the trommel interior. Opposed ends of the apertured axle are rotatably supported by bearings 30 (FIG. 3) on the frame 11. Ends of the axle 27 extend outward of the bearings 30, with one end including a swivel fitting 31 and the opposite end having a cleanout plug 32 (FIG. 6). The plug 32 closes one end of the axle and can be removed for the purpose of purging the axle interior.

The wall 25 is provided with a plurality of perforations 26 of a selected size. The perforations 26 allow passage of selected size material while retaining oversize material. The perforated wall 25 of the trommel 20 is also provided with a continuous series of helical corrugations 33. The corrugations 33 are angularly oriented to the central axis of the trommel so that rotation of the trommel about its central axis will produce axial motion to the placer material held within the trommel. The corrugations act somewhat as screw threads, urging the material toward one of the trommel ends, depending upon the direction of trommel rotation.

It is preferred that the helical angle of the corrugations 33 be arranged in correspondence with the direction of rotation imparted by the drive means 21. With this arrangement, placer material fed into an infeed end 34 of the trommel 20 will be tumbled and moved axially by the corrugations toward a discharge end 35 (FIG. 3). The rate of movement from the infeed end to the discharge end can be varied with the rate of rotation for the trommel 20 as well as the angular orientation of the trommel 20 to a horizontal plane. The angular orientation may be varied by the pivotal nature of the frame 16 upon which the trommel is mounted or by the adjustable legs 15 if a unitized frame 11 is used.

The drive means 21 is preferably connected to the trommel at its discharge end 35. The hopper 23 is thus left unobstructed and, if a gasoline engine is used, there is little chance of gasoline being spilled into the trommel or sluice.

Fluid such as water is supplied to the trommel 20 by a pump means generally shown at 36. The actual pump and drive arrangement may be conventional, such as a centrifugal type pump mounted to a small gasoline engine. The pump is releasably mounted to the frame 11 opposite drive means 21 to balance the weight over the wheel 13 during transit and in storage. The pump can be easily removed from the frame for operation.

An intake hose 37 (FIG. 1) extends from the pump to a water supply. A long discharge hose 40 leads from the discharge side of the pump to a manifold 41 (FIG. 5) on the frame. The length of hose 40 determines the distance the apparatus can be placed from a water source.

Figure 4:
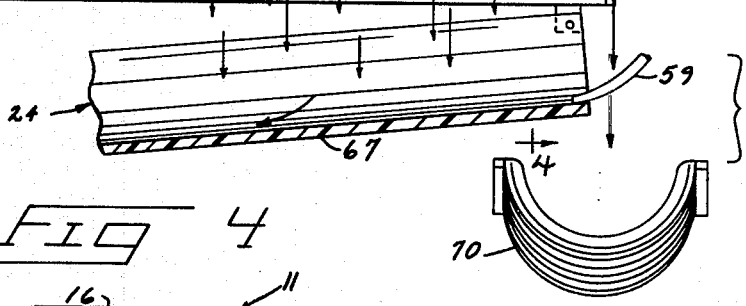
FIG. 4 is a sectional view taken along line 4—4 in FIG. 3.

The manifold 41 may be supplied with a main shutoff valve 42 used to regulate the water flow. A pair of trommel spray bars 44 (FIGS. 1, 4 and 5) extend from the manifold along opposite sides of the exterior of the trommel 20. Bars 44 are apertured along their lengths and extend the full length of the trommel for directing water spray against the outside surface of the trommel. The spray is intended to dislodge any sized material adhered to the exterior surface of the trommel. Additionally, the water from the spray bars 44 passes through the apertures into the trommel interior to assist in washing and classifying the material held therein. The manifold 41 is also connected to the hollow axle through the swivel connection 31 to deliver water under pressure to the hollow axle. Apertures in the axle direct spray against placer material within the trommel to wash sized material through the trommel perforations 26.

An auxiliary valve 45 is provided on a third discharge line 46 (FIG. 5) that leads between the manifold 41 and a hopper spray bar 47 (FIG. 1). Water is directed to the hopper spray bar 47 and onto the hopper 23 to wash the material downwardly into the infeed end 34 of the trommel. The auxiliary valve 45 may be used to attach a conventional garden hose for cleanup or other purposes.

The hopper 23 is movably mounted to the pivoted frame 16 for selective pivotal movement thereon between an inoperative position (FIG. 2) and an operative position (FIG. 1). In the inoperative position, the hopper substantially covers the drive means 21 at the discharge end of the trommel. A hopper frame 52 is pivotably mounted to the frame 16 by bolts 51 to enable swinging motion of the hopper 23 over the trommel to its infeed end.

The hopper 23 is relatively simple in form, including an enlarged open top end 52 and a reduced bottom end 53. The bottom end is longitudinally offset from the top end to protrude into the infeed end 32 of the trommel (FIG. 3) to avoid spillage of the placer material during feeding.

Figure 2:
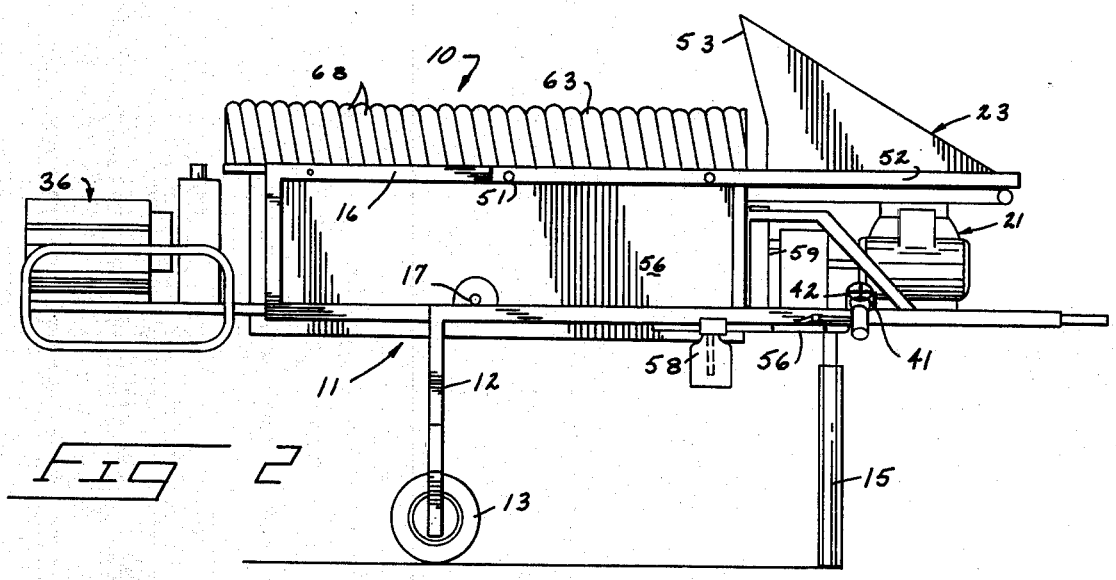
FIG. 2 is a side elevation view showing the present apparatus in a storage or transport mode.
Figure 5:
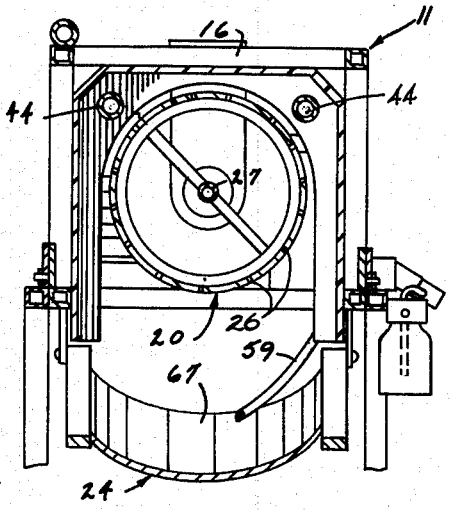
FIG. 5 is a sectional view taken along line 5—5 in FIG. 1.
Figure 5:
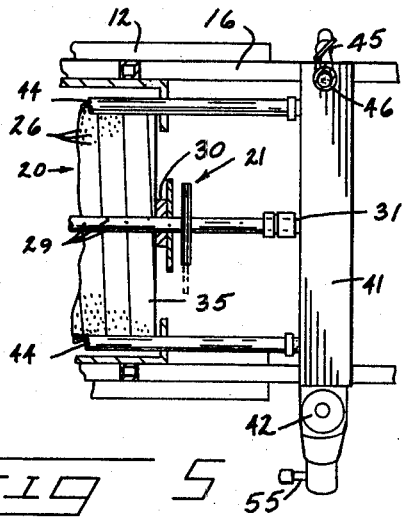

An additional feature of the present device is embodied in a suction pump 56 and associated elements as shown generally in FIG. 2 and more particularly in FIGS. 5 and 7. The suction pump 56 shown in the drawings is a venturi type pump that produces suction through a venturi action using a pressurized flow of water from the pump means 36. Water under pressure is delivered by a flexible tube 54 from a fitting 55 situated upstream of the main valve 42. The suction force produced through the suction pump 56 may be varied by opening or closing the main valve 42. In doing this, the water pressure through the pump connecting tube 54 is varied, directly affecting the draw or suction head produced at the venturi. It is noted that other forms of appropriate suction pumps may be utilized. For example, a standard form of electrical or other mechanical form of pump can be mounted to the frame along with a battery or other power source that would operate satisfactorily. The present hydraulic operated pump, however, is desirable since it makes use of the existing pump means 36.

The suction pump is connected to a suction hose 57 leading through a settling tank 58 to a remote, intake end. The hose 57 will draw water and concentrated material to the settling tank 58. A discharge hose 59 is also connected to the pump 56 for receiving water therefrom. The discharge hose 59 (FIG. 7) leads around the frame to feed back into the intake end of the sluice 24. Therefore, water and concentrated material can be drawn from the sluice while in operation and be directed into the settling tank 58 where heavy values will separate from the water. The water is then recycled back again to the sluice. Any values accidently being drawn through the discharge and recycled through the sluice may be picked up again by the suction hose.

The sluice 24, as shown in FIGS. 1 and 2, is preferably formed in elongated sluice sections 63, 67. Such sections 63, 67 may be interfitted in end to end relation to complete the fully extended length desired. The sluice sections 63, 67 may be supported along the ground surface by means of upright adjustable legs 64 (FIG. 1). The legs 64 enable angular adjustment of the sluice relative to the ground surface and to the axis of the trommel 20.

The sluice 24 functions as a concentrator to separate values from the sized pulp material received from the trommel. To this end, the sluice sections 63, 67 are semicylindrical in cross section. Section 68 is provided with angular corrugations 66. The corrugations produce directional flow of water and sized material along its length in such a manner that the heavier (higher specific value) particles become separated from the remaining particles or "tailings". The tailings are carried along with the flowing water to a sluice discharge 68. Further description of the corrugations and sluice details may be found in U.S. Pat. No. 3,970,551 granted to Mynie L. Wright on July 20, 1976.

The sluice sections 63, 67 are adapted to be stored on the frame 11 over the trommel 20 as shown in FIG. 2. The sections will nest, one on the other and can be tied down to the framework 12 for storage or transport. The overall effective length of the apparatus is thereby kept at a minimum.

The infeed or inner end of the sluice 24 is provided with a smooth intake sluice section 67 (FIG. 3). Section 67 has a semicylindrical cross section to interfit with the corrugated section 63 and provide a smooth transition for material flowing along its length onto the corrugated section 63. The smooth section 67 can be nested for storage or transport along with the remaining section 63.

FIGS. 1 and 3 show a secondary sluice 70 that may be provided to catch discharge material from the trommel. The secondary sluice 70 may be positioned with its infeed end directly below the discharge end of the trommel to catch oversized material that is not capable of passing through the perforations 26. The oversized material can contain large particles of valuable material that would otherwise be discarded. The secondary sluice 70 is essentially identical to the sluice sections 63. It may be attached by appropriate brackets (not shown) on the frame or supported by adjustable legs similar to those shown at 64 in FIG. 1. The secondary sluice 70 recieves the oversize material and some water from the trommel. Additional water might be provided through use of a short hose (not shown) connected to the auxiliary valve 45 in order to provide a steady flow along the relatively short sluice length.

Prior to operation, the present apparatus 10 is transported to an area selected to be mined simply by lifting the hand grips 14 and manually pushing or pulling the apparatus along on the wheels 13. The weight of the apparatus is sufficiently light to enable transport to many areas that are otherwise inaccessible to much larger equipment.

Upon arriving at the mining site, the apparatus can be converted from the transport mode (FIG. 2) to the operational mode (FIG. 1). To do this, the prospector first disengages the pump means 36 from the frame where it was carried to substantially balance the load over the axis of the wheels. The pump means 36 may be placed near a water source such as a stream, pond or river. The intake hose 37 is then placed into the water supply and connected to the intake port of the pump. The discharge hose is then connected between the pump and the manifold 41.

Next, the sluice sections 63 are moved from their nested stack on the frame and connected end-to-end with the first, smooth intake section 67 positioned below the trommel and extending axially along the length thereof as illustrated in FIG. 3. The legs 64 are then attached and the sluice angle is adjusted relative to the ground. A slight angle is preferred toward the discharge end 68 to encourage steady flow of sized placer material and water over the corrugations and toward the discharge end. The secondary sluice is attached to the frame below the trommel discharge and adjusted similarly to the main sluice 24.

Next, the hopper 23 is swung into place from its storage position substantially covering the drive means 21 to its operative position adjacent the intake end of the trommel. The hopper is secured into position with appropriate mounting bolts. The apparatus is now ready for use.

To initiate operation, the prospector first starts the pump means 36 and opens the main valve 42 on the manifold to initiate flow of water to the various spray bars. Pumped water is delivered forceably through the central axle and is sprayed directly into the trommel. Water is also sprayed under pressure from the longitudinal trommel spray bars 44 onto the exterior surface of the trommel. Additionally, water is directed through the hopper spray bar 46 and through the auxiliary valve and appropriate hose to the secondary sluice.

The next step is to start rotation of the trommel 20. This is done by actuating the drive means 21. If the drive means 21 is provided in the form of a gasoline engine, the engine is started and engaged with the proper gearing and clutch arrangements to initiate desired rotation of the trommel. If a hydraulic drive means is provided, actuation may be initiated simply by operating a valve on the manifold.

When the trommel is rotating at a desired speed (within a range between 6 and 20 rpm, depending upon the size and condition of the placer), rough placer material may be shoveled into the hopper 23. Two or three shovels full of material initially is sufficient.

The placer material is washed down the walls of the hopper and is discharged into the infeed end of the trommel. The rotating action of the trommel and the angular corrugations subject materials to several forces. Tumbling, abrasion and acceleration (tearing apart of the material along the central axis) all takes place throughout the entire length of the trommel barrel. Trommel action with water under pressure breaks up most types of material, including clays, and exposes values to the perforated wall of the trommel. Separated material and values (small particles) drop into the intake section 67 of the sluice along with much of the water.

The prospector should observe the action within the trommel to determine whether the placer material is moving adequately along the trommel length. If the material is spreading too quickly along the trommel length, he may adjust the angle of the trommel by pivoting the frame 16 so the trommel discharge end is slightly more elevated than before. Alternatively, when a unitized frame is used, the same adjustment can be made by adjusting the length of the legs 15.

In some situations, it may be desirable to position the trommel discharge end at an elevation higher than the intake end (FIG. 8, dashed lines). The corrugations, in this situation, would be relied upon solely to work the placer material toward the discharge end. The material will remain within the trommel, sifting and tumbling along the corrugations steadily until the oversize material is discharged from the discharge end. This trommel angle may be used when mining clay materials that would otherwise be very difficult to break apart. The action of the trommel and water spray from the central axle, however, is very effective in breaking up such material.

If sand or other relatively, fine loose material is being mined, the trommel 20 can be tipped with the discharge end situated substantially downward from the intake end (FIG. 8, solid line). This allows a faster flow of material from the hopper into the trommel and accommodates the quick, easy separation of the material into sized placer material which falls through the perforations and oversize material which is discharged from the trommel discharge end onto the secondary sluice.

When properly sized placer material and water have been delivered to the sluice, it is time to examine the angle of the sluice to determine whether flow along the sluice is adequate. If sand is clogging along the corrugations, it is desirable to lower the discharge end of the sluice to produce faster flow. Typically, a steeper angle is less harmful than a shallow sluice angle as clogging will disrupt the effect of the corrugations and values will be discharged with the tailings.

The machine is fully operational after the sluice angle has been adjusted. The hopper can now be fed at a relatively constant rate.

The corrugations along the sluice 24 are checked periodically for "color" or small flecks of material such as gold. Values collecting within the corrugations should be removed from time to time with the suction pump 56 and hose 57.

It is pointed out that this is done during operation and that the apparatus is not shut down. This is an important feature. Continued water flowing constantly does not allow values to escape due to sudden change in the water flow characteristics that might allow flotation of values due to surface tension, etc.

The free end of suction hose 57 is directed over the corrugations containing values to draw the values and water inwardly through the suction hose and into the settling tank 58. The heavy values settle to the bottom of the suction tank 58 while the water is drawn off at the top of the tank. Any values remaining suspended within the settling tank will possibly be drawn into the discharge hose 59. However, the discharge end of the hose 59 is positioned at the intake end of the sluice so any values discharged from the hose 59 will be recycled downwardly along the sluice to be concentrated again along the corrugations and collected by the suction hose.

Operation of the suction device facilitates continuous operation of the present apparatus. Feed through the hopper may be continued as well as flow of water through the various spray tubes. The amount of water drawn through the suction pump 56 is relatively insignificant compared to the amount of water flowing through the sluice. The sluice action is therefore not impaired.

The settling tank 58 may be removed when it becomes sufficiently filled, and replaced with a clean tank. Again, this step can be accomplished without interrupting continuous operation of the apparatus.

It is pointed out that because of sluice efficiency, other values are classified in addition to gold. Platinum and silver have also been collected separately. It is further pointed out that the nature of the sluice completely concentrates the values so further processing is eliminated. There is no need for further concentration of gold, for example, by use of retorts or other tedious particles since the material is effectively separated along the sluice length from the remaining sized placer material.

Tailings are discharged from the discharge end of the sluice. Tailings or oversized placer material discharged from the trommel may be received in the secondary sluice. The oversized material is received at one end of the secondary sluice 70 and is washed along the corrugations thereof by the flowing water. A concentrating action takes place here that is similar to the action taking place within the longer sluice 24. The suction pump can also be used along the length of the secondary sluice 70 or hand picking may be used on the larger, oversized particles.

On completion of the mining process, the apparatus can by reassembled to the transport mode. This is done simply be reversing the steps described earlier for assembly prior to operation.

The above description and attached drawings have been given by way of example to set forth a preferred form of the present invention. Other forms may be envisioned which fall within the scope of the following claims. For example, the drive means 21 can be provided in the form of a hydraulic motor operating from connection with the pump means 36. Other appropriate forms of suction pumps could also operate serviceably. Other modifications in addition to those discussed above are also envisioned which fall within the scope of the following claims.

Having thus described the invention, we claim:

1. A portable mining apparatus for classifying placer material into sized and oversized grades and recovering values therefrom, comprising:

a portable frame;

a hollow trommel mounted to the frame for rotation about a central trommel axis having an open infeed end and an opposed discharge end;

said trommel having a continuous perforated wall formed about the central axis for passing the sized grade and retaining the oversized grade of the placer material;

said perforated wall having spiral corrugations disposed angularly along the trommel axis in a helix configuration so that rotation of the trommel will result in axial movement of free placer material held therein to agitate the material to continuously present sized grade material to the perforations of the wall and for delivering oversized grade out through a discharge end;

a hollow axle, coaxial with the central axis, mounting said trommel to the frame;

wherein said axle includes a plurality of apertures spaced along its length;

drive means on the frame for rotating the trommel about the central axis;

pump means having a discharge connected to the hollow axle for pumping water through the axle apertures and into the trommel;

elongated sluice means mountable below said trommel for receiving water and sized grade material at an intake end from the trommel and for concentrating values from the sized grade;

a suction tube operably mounted to the frame;

suction pump mounted to the suction pump for collecting water and concentrate from the sluice means;

a settling tank connected to the suction tube for receiving water and concentrate; and a discharge tube leading from the settling tank to the intake end of the sluice for recycling water and placer material not collected within the settling tank.

2. The apparatus as claimed by claim 1 wherein said frame includes:

a first frame section and a pivotable second frame section mounted to the first frame section for selective pivotal movement about a pivot axis that is horizontal and transverse to the central trommel axis, and wherein the trommel is mounted to the pivotable frame section.

3. The apparatus as claimed by claim 2 wherein said first frame section is wheel supported and includes a hand grip at an end thereof.

4. The apparatus as claimed by claim 1 wherein said drive means is operatively connected to the trommel at the discharge end thereof and is operated to rotate the trommel in a direction complementary to the angle of corrugations so placer material placed at the infeed end of the trommel will be worked toward the discharge end by the corrugations.

5. The apparatus as claimed by claim 4 wherein said frame includes:

a stationary frame section and a pivotable frame section mounted to the stationary frame for selective pivotal movement about a pivot axis that is horizontal and transverse to the central trommel axis; and wherein the trommel is mounted to the pivotable frame section.

6. The apparatus as claimed by claim 1 wherein the drive means is operable to turn the trommel at a rate between 6 and 20 rpm.

7. The apparatus as claimed by claim 1 further comprising:

a pair of trommel spray bars on the frame extending radially alongside the trommel on opposite sides of the central axis connected to the discharge of the pump means, for directing a spray of water radially inward against the continuous perforated wall of the trommel.

8. The apparatus as claimed by claim 1 further comprising:

a hopper means having open top and a bottom end for projecting into the infeed end of the trommel to direct placer material into the trommel; and means mounting the hopper means to the frame for selective movement of the hopper from an inoperative storage position to an operative position adjacent the trommel infeed with the bottom end projecting into the infeed end.

9. The apparatus as claimed by claim 8 wherein:

the drive means is situated adjacent the discharge end of the trommel wherein the hopper, in its inoperative position, covers the drive means.

10. The apparatus as claimed by claim 1 wherein the sluice means is comprised of longitudinally interconnected sluice sections of complementary cross section that can be dismantled and mounted to the frame in a nested stack.

11. The apparatus as claimed by claim 1 further comprising adjustable support means removably mounted to the sluice means for supporting the length of the sluice means along a ground surface and for selective vertical adjustment of the sluice angle along its length relative to the central trommel axis.

12. The apparatus as claimed by claim 1 further comprising a secondary sluice having intake and discharge ends, mountable to the frame with the intake end positioned below the discharge end of the trommel, for receiving the oversized grade and water discharged therefrom and for concentrating values therein.

13. The apparatus as claimed by claim 1 further comprising:

hopper means having open top and bottom ends for receiving and feeding placer material into the trommel at the infeed end thereof; and a hopper spray bar mounted to the hopper adjacent the open top end and connected with the pump means for directing a spray of water onto placer material within the hopper to wash the placer through the bottom hopper end and into the trommel.

14. The apparatus as claimed by claim 13 further comprising:

a pair of trommel spray bars on the frame extending axially alongside the trommel on opposite sides of the central axis connected to the discharge of the pump means, for directing a spray of water radially inward against the continuous perforated wall of the trommel.

15. The apparatus as claimed by claim 13 wherein the hollow axle, trommel spray bars and hopper spray bar are interconnected with the pump means by a common manifold on the frame, the manifold being releasably connected to the pump means.

16. The apparatus as claimed by claim 14 wherein the frame is movably supported by wheels and the pump means is removably mounted to the frame in a transport position located with respect to the drive means to balance the weight of the apparatus on opposite sides of the wheels.

17. The apparatus as claimed by claim 1 wherein the hollow axle is fixed to the trommel and is journalled by bearings at opposite ends thereof to the frame, and further comprising:

a removable cleanout plug threadably closing one end of the hollow axle; and a swivel fitting interconnecting the remaining end of the axle with the pump means, to allow rotation of the axle and trommel about the central axis relative to the frame and pump means.

18. The apparatus as claimed by claim 1 further comprising:

a flow control valve connected to the discharge of the pump means, operable to selectively restrict flow of water to the hollow axle; and wherein said suction pump means is connected to the discharge of the pump means between the flow control valve and pump means.

19. The apparatus as claimed by claim 1 further comprising:

means mounting the hopper means to the frame for selective movement of the hopper from an inoperative storage position to an operative position adjacent the trommel infeed with the bottom end projecting into the infeed end.

20. A portable mining apparatus for classifying placer material into sized and oversized grades and recovering values therefrom, comprising:

a portable frame;

a hollow trommel mounted to the frame for rotation about a central trommel axis having an open infeed end and an opposed discharge end;

said trommel having a continuous perforated wall formed about the central axis for passing the sized grade and retaining the oversized grade of the placer material;

said perforated wall having spiral corrugations disposed angularly along the trommel axis in a helix configuration so that rotation of the trommel will result in axial movement of free placer material held therein to agitate the material to continuously present sized grade material to the perforations of the wall and for delivering oversized grade out through a discharge end;

a hollow axle, coaxial with the central axis, mounting said trommel to the frame;

wherein said axle includes a plurality of apertures spaced along its length;

drive means on the frame for rotating the trommel about the central axis;

pump means having a discharge connected to the hollow axle for pumping water through the axle apertures and into the trommel;

elongated sluice means mountable below said trommel for receiving water and sized grade materials from the trommel and for concentrating values from the sized grade;

hopper means having open top and bottom ends for receiving and feeding placer material into the trommel at the infeed end thereof;

a hopper spray bar mounted to the hopper adjacent the open top end and connected with pump means for directing a spray of water onto placer material within the hopper to wash the placer through the bottom hopper end and into the trommel;

a pair of trommel spray bars on the frame extending axially alongside the trommel on opposite sides of the central axis connected to the discharge of the pump means, for directing a spray of water radially inward against the continuous perforated wall of the trommel; and wherein the frame is movably supported by wheels and the pump means is removably mounted to the frame in a transport position located with respect to the drive means to balance the weight of the apparatus on opposite sides of the wheels.

21. The apparatus as claimed by claim 20 wherein the hollow axle, trommel spray bars and hopper spray bar are interconnected with the pump means by a common manifold on the frame, the manifold being releasably connected to the pump means.

22. The apparatus as claimed by claim 20 wherein the hollow axle is fixed to the trommel and is journalled by bearings at opposite ends thereof to the frame, and further comprising:

a removable cleanout plug threadably closing one end of the hollow axle; and a swivel fitting interconnecting the remaining end of the axle with the pump means, to allow rotation of the axle and trommel about the central axis relative to the frame and pump means.

23. The apparatus as claimed by claim 20 further comprising:

a flow control valve connected to the discharge of the pump means, operable to selectively restrict flow of water to the hollow axle.

24. The portable mining apparatus as defined by claim 20 further comprising:

a first frame section and a pivotable second frame section mounted to the first frame section for selective pivotal movement about a pivot axis that is horizontal and transverse to the central trommel axis, and wherein the trommel is mounted to the pivotable frame section.

25. The apparatus as claimed by claim 20 wherein said drive means is operatively connected to the trommel at the discharge end thereof and is operated to rotate the trommel in a direction complementary to the angle of the corrugations so placer material placed at the infeed end of the trommel will be worked toward the discharge end by the corrugations.

26. The apparatus as claimed by claim 20 further comprising adjustable support means removably mounted to the sluice means for supporting the length of the sluice means along a ground surface and for selective vertical adjustment of the sluice angle along its length relative to the central trommel axis.

27. The apparatus as claimed by claim 26 wherein:

the drive means is situated adjacent the discharge end of the trommel and wherein the hopper, in its inoperative position, covers the drive means.

28. The apparatus as claimed by claim 20 further comprising a secondary sluice having intake and discharge ends, mountable to the frame with the intake end positioned below the discharge end of the trommel, for receiving the oversized grade and water discharged therefrom and for concentrating values therein.

* * * * *